US009233557B2

(12) United States Patent
Hoshina et al.

(10) Patent No.: US 9,233,557 B2
(45) Date of Patent: Jan. 12, 2016

(54) COATING APPARATUS AND IMAGE FORMING SYSTEM

(71) Applicants: Masaru Hoshina, Ibaraki (JP); Yasushi Hashimoto, Ibaraki (JP); Sho Sawahata, Ibaraki (JP); Akitomo Kuwabara, Ibaraki (JP); Hironori Numata, Ibaraki (JP); Tetsuya Ohba, Ibaraki (JP); Jun Ogino, Kanagawa (JP); Kahei Nakamura, Tokyo (JP)

(72) Inventors: Masaru Hoshina, Ibaraki (JP); Yasushi Hashimoto, Ibaraki (JP); Sho Sawahata, Ibaraki (JP); Akitomo Kuwabara, Ibaraki (JP); Hironori Numata, Ibaraki (JP); Tetsuya Ohba, Ibaraki (JP); Jun Ogino, Kanagawa (JP); Kahei Nakamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/605,267

(22) Filed: Jan. 26, 2015

(65) Prior Publication Data

US 2015/0210091 A1 Jul. 30, 2015

(30) Foreign Application Priority Data

Jan. 27, 2014 (JP) ..... 2014-012728

(51) Int. Cl.

| | |
|---|---|
| ***B41J 2/01*** | (2006.01) |
| ***B41J 11/00*** | (2006.01) |
| ***B05C 1/08*** | (2006.01) |

(52) U.S. Cl.
CPC ..... *B41J 11/0015* (2013.01); *B05C 1/08* (2013.01); *B05C 1/0821* (2013.01)

(58) Field of Classification Search
CPC ..... B41J 11/0015; B41J 23/14
USPC ..... 347/101
See application file for complete search history.

(56) References Cited

U.S. PATENT DOCUMENTS

| | | | | |
|---|---|---|---|---|
| 2005/0110857 | A1* | 5/2005 | Matsumoto et al. | 347/104 |
| 2011/0193902 | A1* | 8/2011 | Yamanobe | 347/9 |
| 2014/0014035 | A1* | 1/2014 | Uemura et al. | 118/696 |
| 2014/0020625 | A1* | 1/2014 | Masuo et al. | 118/688 |
| 2014/0023791 | A1* | 1/2014 | Peleg et al. | 427/428.01 |

FOREIGN PATENT DOCUMENTS

| | | |
|---|---|---|
| JP | H07-156538 | 6/1995 |
| JP | 2012-053332 | 3/2012 |

* cited by examiner

*Primary Examiner* — Julian Huffman
*Assistant Examiner* — Sharon A Polk
(74) *Attorney, Agent, or Firm* — Oblon, McClelland, Maier & Neustadt, L.L.P.

(57) ABSTRACT

A treatment liquid coating apparatus includes a conveyance member to convey a recording medium; a coating roller, to apply treatment liquid on the recording medium, driven to rotate with the conveyance of the conveyance member; a pressure roller to press against the coating roller to hold the recording medium that is placed between the coating roller and the pressure roller; and a reciprocating mechanism to reciprocate the coating roller in a width direction of the recording medium during printing.

13 Claims, 8 Drawing Sheets

COATING APPARATUS AND IMAGE FORMING SYSTEM

BACKGROUND OF THE INVENTION

1. Field of the Invention

The present invention relates to a coating apparatus to apply treatment liquid to a recording medium and an image forming system including the coating apparatus.

2. Description of the Related Art

Image recording of an inkjet method is becoming increasingly popular these days because of its advantage that colorization can be easily realized, in addition to its advantages of low noise and low running cost. But, when an image is formed on a recording medium which is a non-manufacturer-specified paper, problems related to initial image quality such as image blur, image concentration change, color tone change, image show-through, etc., occur. In addition, problems related to robustness of images such as water resistance, weather resistance, etc., occur.

In order to solve these problems, in one image forming apparatus proposed in JP-H07-156538-A, treatment liquid having a function to agglomerate the ink is applied to a recording medium just before ink droplets are ejected onto the recording medium (paper).

The above-mentioned Patent document disclose a method to apply the pretreatment liquid on the entirety of the sheet, using rollers.

FIG. 8 shows a schematic diagram illustrating a configuration in which coating material (treatment liquid) is applied to a sheet of recording media using a roller, according to the related art. In FIG. 8, a sheet of recording media W is wound around a platen roller 97 rotated by a motor, using a paper pressing member 98. Coating material 90, contained in a coating unit 96, is drawn up by an agitation-supply roller 91 and then is applied to a roller surface of a coating roller 94 by conveyance thin-coating rollers 92 and 93 to form a thin coating on the surface of the coating roller 94.

As the coating roller 94 is rotated with the rotation of the platen roller 97 while the coating roller 94 presses against the recording medium W that is wound around the platen roller 97, the coating roller 94 applies the coating material 90 to a surface of the recording medium W. Along with these processes, an ink ejecting head 95 applies ink to the surface of the recording medium W that is coated with the coating material 90. This configuration is proposed in, for example JP-2012-053332-A.

The method of applying the treatment liquid that improves the image quality to an image area of the recording medium in advance using the roller enables the applied treatment liquid to have higher viscosity than the method using a sprayer (e.g., a spraying head). Therefore, the method using the roller is superior to the method using the sprayer in forming a thinner coating and lessening the image blur.

However, in the above-described coating device that uses the roller to apply the treatment liquid, the roller is readily abraded at the portion thereof that comes in contact with the edges of the sheet. When the sheet width is changed, due to lack of the liquid in abraded portions of the surface of the coating roller, white dots may appear in the image formed on the recording medium, and due to excess liquid arising from the accumulated liquid in the abraded portions, unevenness in the image density may occur.

SUMMARY OF THE INVENTION

In one aspect, the present invention provides a coating device that has a roller to apply treatment liquid, and the coating device prevents abrasion at the contact portion where the roller comes in contact with edges of a recording medium.

In an embodiment which solves or reduces one or more of the above-mentioned problems, the present invention provides a treatment liquid coating apparatus including a conveyance member to convey a recording medium; a coating roller, to apply treatment liquid on the recording medium, driven to rotate with the conveyance of the conveyance member; a pressure roller to press against the coating roller to hold the recording medium that is placed between the coating roller and the pressure roller; and a reciprocating mechanism to reciprocate the coating roller in a width direction of the recording medium during printing.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

Figure 1:
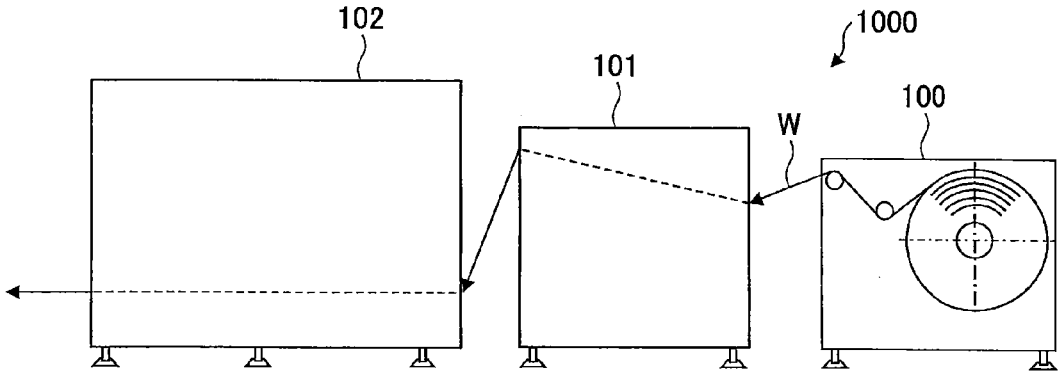
FIG. 1 is a schematic diagram illustrating an inkjet type image forming system according to embodiments of the present invention.

In the following, embodiments of the present invention will be described with reference to the accompanying drawings. It should be noted that configuration elements which include substantially the same functional configurations in the present specification and the drawings are assigned the same reference numerals and the duplicated description is omitted.

[Entire Configuration]

FIG. 1 shows the configuration of the embodiments of the present invention. Specifically, FIG. 1 is a schematic diagram illustrating a part of an inkjet type image forming system 1000 of the embodiment of the present invention.

As shown in FIG. 1, a recording medium W that is a sheet (elongated sheet) fed from a sheet feeding apparatus 100 is fed to a pretreatment apparatus 101 having a coating device 330. In order to solve the problems such as image blur, image concentration change, color tone change, image show-through etc., the pretreatment apparatus 101 applies a treatment liquid, that has a function to coagulate ink to be applied to an image forming surface of the recording medium W, to the recording medium W. The face to which the treatment liquid is applied is one face or both faces in response to a desired printed matter.

Then, the recording medium is fed to a first inkjet printer 102 provided downstream in a direction in which the recording medium is conveyed, and then the image is formed on the face that is coated with the treatment liquid to form a desired image. When performing duplex printing, thereafter, a reverse device reverses the sides of the recording medium W, which is then fed to a second inkjet printer. The second inkjet printer ejects the ink droplet to form the back side of the recording medium W to form a desired image. After image formation, after treatment process is executed in a predetermined after-treatment apparatus.

Figure 2:
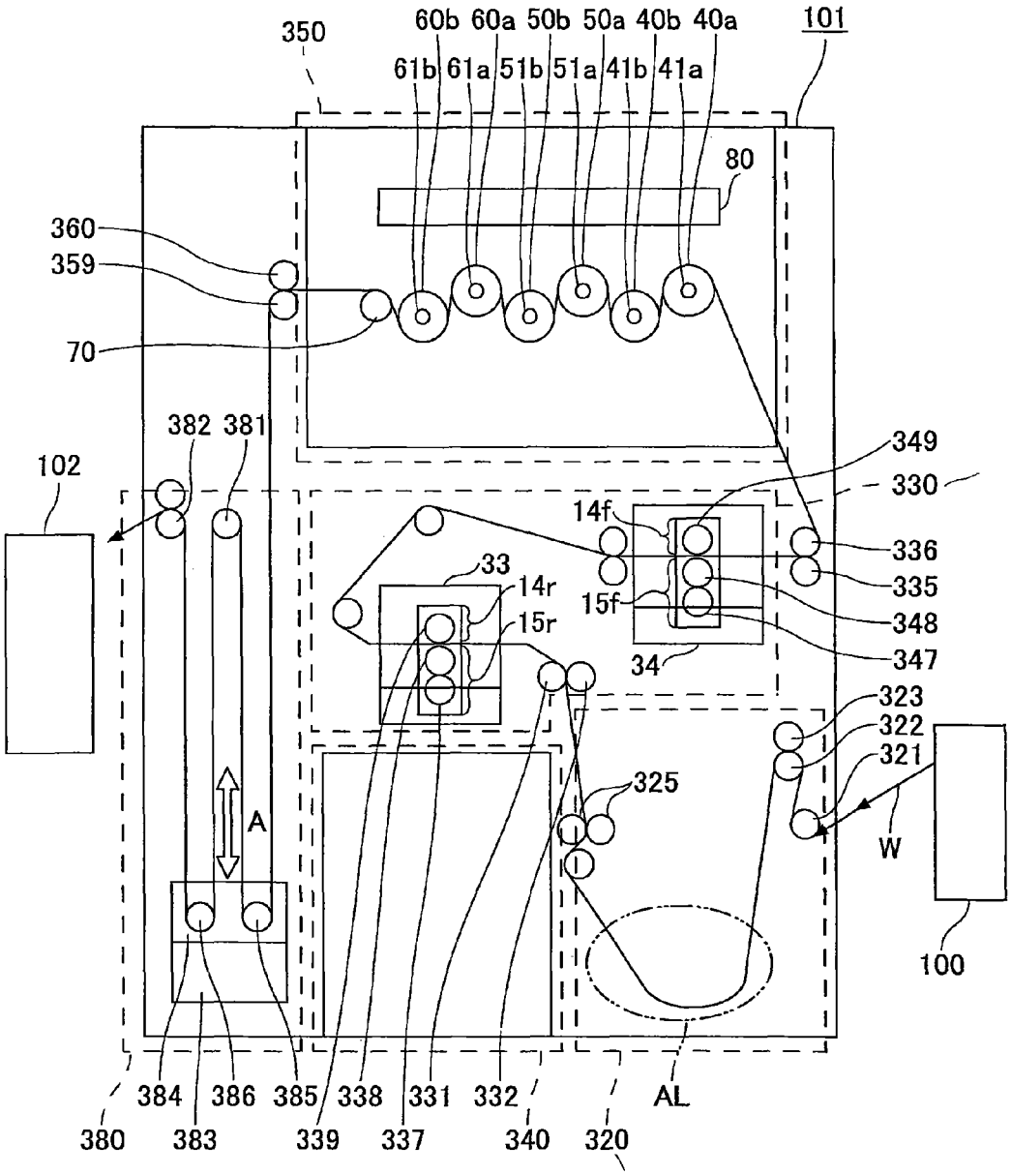
FIG. 2 is a schematic diagram illustrating a treatment liquid coating apparatus used for the image forming system of embodiments of the present invention.

FIG. 2 is a schematic diagram illustrating the pretreatment apparatus (pretreatment liquid coating and drying apparatus) 101 used for the image forming system 1000.

Next, with reference to FIG. 2, the configuration of the pretreatment apparatus 101 is described. The pretreatment apparatus 101 includes the pretreatment liquid coating apparatus (coating device) 330. In order to dry the pretreatment liquid on the recording medium W, a heating unit (recording medium heating device) 350 is provided downstream from the pretreatment liquid coating device (apparatus) 330 in the medium conveyance direction.

Further, the pretreatment apparatus 101 includes an air loop unit 320, a pretreatment liquid supply unit 340, and a dancer unit 380, in addition to the pretreatment liquid coating device 330 and the heating unit 350.

The air loop unit 320 includes a guide roller 321, a feed in (FI) roller 322, and a FI nip roller 323, which rollers are rotatably supported therein.

In the air loop unit 320, the guide roller 321, the FI roller 322 that drives to rotate, and the FI nip roller 323 driven to rotate, guide the recording medium W fed from the sheet feeding apparatus 100 inside the air loop unit 320. At this time, an optical sensor controls the rotation of the FI roller 322 so that the amount of slack of the recording medium W is constant in an air loop AL. After the recording medium W passes through the air loop AL, while a tension force from tension shafts, for stabilizing the conveyance of the recording medium W, is being exerted onto the recording medium W, the recording medium W is conveyed to the pretreatment liquid coating apparatus 330.

After passing through the air loop AL, the recording medium W is conveyed between two edge guides and is conveyed in the shape of S, between two path shafts 325 whose longitudinal direction is arranged orthogonal to a width direction of the recording medium W. The two path shafts 325 are supported by edge guides, and the interval between the edge guides is designed to be a same length of the width of the recording medium W. Herein, the edge guide is movably fixed to the path shaft 325 by a fixing tool such as screw, and the interval between the edge guides is adjusted based on the width of the recording medium W to be used. Due to the functions of the path shafts 325 and the edge guides orthogonal thereto, a moving position of the recording medium in the width direction is restricted, which enables conveying the recording medium stably.

After passing through the path shafts 325 and the edge guides, a tension force from the stable rotating tension shaft is exerted onto the recording medium W to achieve stable conveyance.

The pretreatment liquid coating device 330 includes an in-feed roller 331 and an in-feed nip roller 332 both rotatable, and a back side coating mechanism 33 and a front side coating mechanism 34. The pretreatment liquid coating device 330 further includes a coating controller 81 and a reciprocation controller 82 to control the back side coating mechanism 33 and the front side coating mechanism 34 (see FIG. 3). Further, an out-feed roller 335 and an out-feed nip roller 336 are provided in the treatment liquid coating device 330.

The in-feed nip roller 332 presses against the in-feed roller 331 to convey the recording medium W, and the out-feed nip roller 336 presses against the out-feed roller 335 to convey the recording medium W. The feed rollers 333, 335 and the feed nip rollers 332, 336 function as conveyance members.

The back side coating mechanism 33 includes a squeeze roller 337, a coating roller 338, and a pressure roller 339. In the back side coating mechanism 33, the squeeze roller 337 supplies the treatment liquid to the coating roller 338. While the recording medium W is being conveyed while being clamped between the coating roller 338 and the pressure roller 339, one side (back side) of the recording medium W is being coated with the treatment liquid by the coating roller 338. The pressure roller 339 is provided in a pressure unit 14*r*, and the squeeze roller 337 and the coating roller 338 are provided in a coating unit 15*r*.

After passing through the back side coating mechanism 33, the recording medium W is conveyed to the front side coating mechanism 34.

The front side coating mechanism 34 includes a squeeze roller 347, a coating roller 348, and a pressure roller 349. In the front side coating mechanism 34, the squeeze roller 347 supplies the treatment liquid to the coating roller 348. While the recording medium W is being conveyed while being clamped between the coating roller 348 and the pressure roller 349, the other side (front side) of the recording medium W is being coated with the treatment liquid by the coating roller 348. After passing through the front side coating mechanism 34, the recording medium W is conveyed to the heating unit 35 as a heating device, using the out-feed roller 335 and the out-feed nip roller 336.

Herein, the back side coating mechanism 33 and the front side coating mechanism 34 can be operated selectively, and the pretreatment liquid may be applied to both sides or either the front side or the back side of the recording medium W.

The pretreatment liquid supplying unit 340 retains the treatment liquid, and supplies the pretreatment liquid to the back side coating mechanism 33 and the front-side coating mechanism 34.

The heating unit 350 includes heat rollers 40*a*, 40*b*, 50*a*, 50*b*, 60*a*, and 60*b* provided in this order from upstream to downstream in the conveyance direction, and also includes a sheet delivery roller 70 and a heating controller 80. In the heating unit 350, the controller 80 executes operations to control the heating amount (temperature) of heaters 41*a* through 61*b* corresponding to the heat rollers 40*a* through 60*b*.

The heating rollers 40*a* through 60*b* are arranged in two rows and in a zigzag state. The recording medium W, which is wound around the respective heat rollers 40*a*, 40*b*, 50*a*, 50*b*, 60*a*, and 60*b* in this order, is conveyed in the heating unit 350 by the out-feed roller 335 and the feed nip roller 336 and a feed roller 359 and a feed nip roller 360. The respective heat roller 40*a* through 60*b* are driven and rotated depending on the conveyance of the recording medium W.

Herein, the rotation of the heat rollers 40*a* through 60*b* is driven with the conveyance of the recording medium W, so that it is not necessary to provide the motor as a driving source to drive and rotate the heat rollers 40*a* through 60*b*, which can save the space for proving the motors and allow the pretreatment apparatus 101 become compact.

Further, in the heating unit 350, the recording medium W on which the pretreatment liquid is applied and dried is clamped between the driving feed roller 359 and the feed nip roller 360 to convey the recording medium W to the dancer unit 380.

The dancer unit 380 includes two guide rollers 381 and 382, a movable frame 384, a position detector to detect the position of the movable frame 384, and dancer rollers 385 and 386 attached to the movable frame 384. The movable frame 384, to which a weight 383 is attached in a lower portion, is provided movable with the dancer rollers 385 and 386 in directions indicated by an arrow A. The recording medium W is wound around the guide rollers 381 and 382 and the dancer rollers 385 and 386 in the shape of W.

The dancer unit 380 controls the conveyance amount of the feed roller 359 based on the output of a position detector, so as to adjust the position of the movable frame 384 in the vertical direction. The position of the movable frame 384 is adjusted, which enables ensuring a buffer of the recording medium W between the pretreatment apparatus 101 and the following first inkjet printer 102.

The recording medium W heated by the heating unit 350 is cooled in the dancer unit 380 and is conveyed to the following first inkjet printer 102.

With this configuration, the pretreatment apparatus 101 applies the pretreatment liquid to the recording medium W for preventing the ink bleeding and helping ink permeation so as to improve the image quality, and then conveys the recording medium W to the following first inkjet printer 102.

Figure 3:
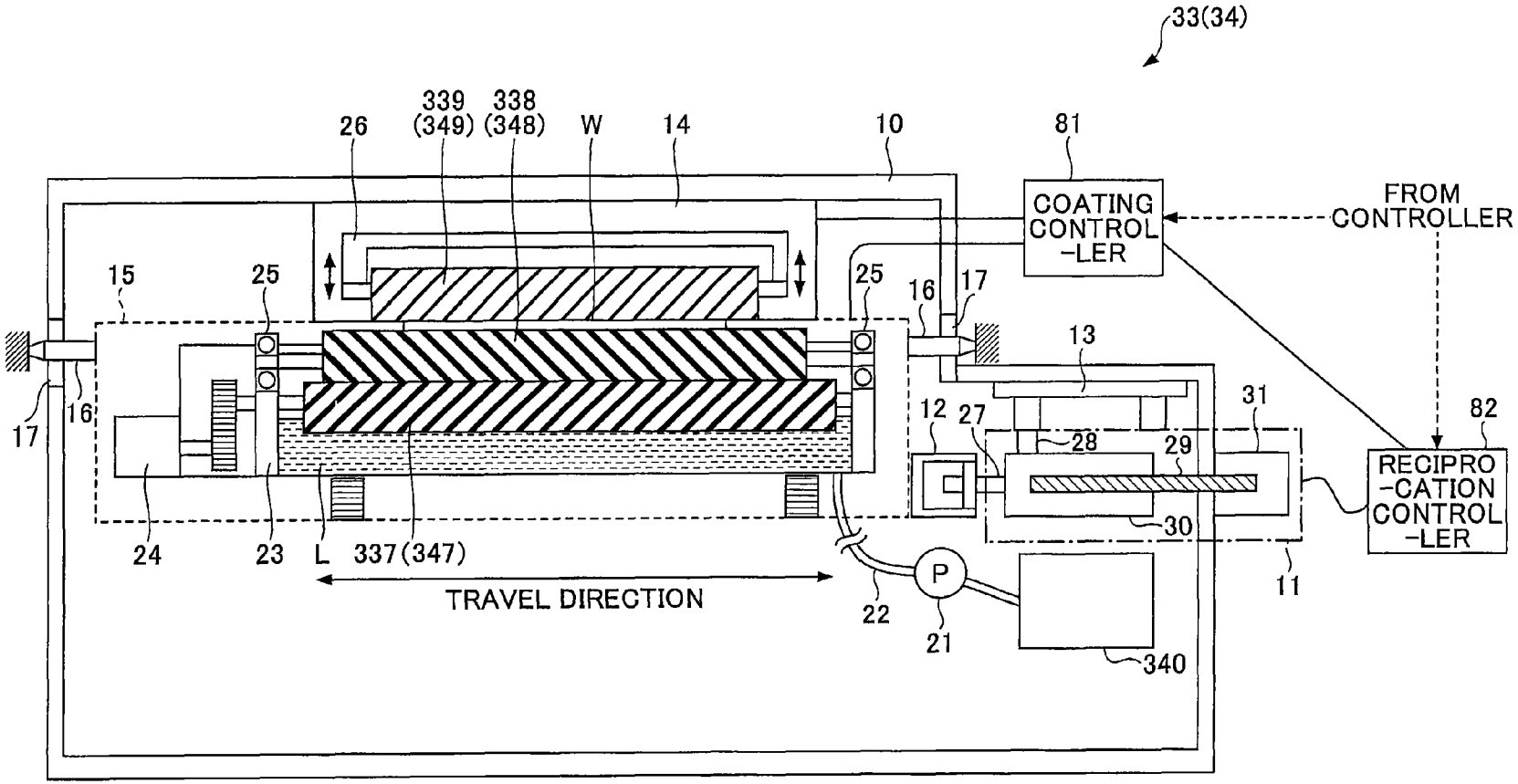
FIG. 3 is a schematic diagram illustrating a coating mechanism included in the treatment liquid coating apparatus shown in FIG. 2.

FIG. 3 is a schematic diagram illustrating a configuration of the coating mechanism 33 according to the embodiments of the present invention. In the present embodiments, both the back side coating mechanism 33 and the front side coating mechanism 34 shown in FIG. 2 function as coating mechanism, and configuration thereof are similar, so the numerals related to the coating mechanism 33 are used below.

The coating mechanism 33 includes a reciprocating mechanism 11 in addition to the pressure unit 14 (14*r*, 14*f*) and the coating unit 15 (15*r*, 15*f*). The coating controller 81 and the reciprocation controller 82 are connected to the coating mechanism 33. Further, the coating unit 15, including a treatment liquid retainer, is connected to a treatment liquid supply unit (cartridge) 340 that is replenished with the toner.

The squeeze roller 337, the coating roller 338, and the vicinity thereof are provided in the coating unit 15. The pressure roller 339 and the vicinity thereof are provided in the pressure unit 14. The coating controller 81 receives the operation command from the controller of the image forming system 1000 and adjusts the members in the coating unit 15 and the members of the pressure unit 14 of the coating mechanism 33 so as to adjust the coating amount of the pretreatment liquid (the amount of applying the pretreatment liquid to the recording medium).

The treatment liquid retained in the pretreatment supply unit 340 is supplied to a supply pan 23 of the coating unit 15 via a supply path 22 as ink conveyance members, electrically driven by a pump 21, for example, a tube pump or a diaphragm pump.

The treatment liquid L retained in the supply pan 23 is drawn up by rotation of the squeeze roller 337 driven by a motor (coating amount adjusting motor) 24. As one example, the squeeze roller 337 is formed to have a surface on which grooves are formed, such as an anilox roller, or a wire bar. Using the grooved roller, even when viscosity of the treatment liquid and a printing speed are changed, the drawing-up amount of the pretreatment liquid in the drawing up process is less likely to be affected.

Herein, an anilox roller is a metal roller having a surface on which the thin grooves are formed used for printing and paper milling, and the grooves shapes of triangles and polyhedrons resembling pyramid shape. If the roller without grooves is used, due to various reasons such as the printing speed and the liquid viscosity, the amount of passing liquid may become unstable. However, by forming grooves, the amount of passing liquid between the rollers can be increased, which enables the amount of passing liquid to be stable due to the speed and viscosity.

Although a wire bar having a metal bar around which the various thicknesses of wire are wound can be used as the squeeze roller 337, it is more favorable that the anilox roller having surface on which the groove be directly formed on a metal roller be used as the squeeze roller 337, because the wire is susceptible of coming untied.

A part of the treatment liquid pumped up by the squeeze roller 337 is scraped off by the nip (contact area) between the coating roller 338 and the squeeze roller 337 so that the remaining liquid may be made uniform as a thin coating extending over the coating roller 338.

At this time, by changing a nip pressure of the nip area between the coating roller 338 and the squeeze roller 337, the amount of the treatment liquid scraped off can be controlled. The treatment liquid extending on the coating roller 338 is applied to the recording medium W that is clamped between the pressure roller 339 and the coating roller 338.

Both ends of the coating roller 338 are supported by bearings 25, and the coating roller 338 is rotated in conjunction with the conveyance of the recording medium W. During this time, when the coating amount is great and the frictional resistance between the recording medium W and the coating roller 338 is low, the recording medium W slips on the coating roller 338. Therefore, abrasion occurs at a contact portion of a surface of the coating roller 338 that comes in contact with the edges of the recording medium W.

Herein, a lifting mechanism 26 is attached to both ends of the pressure roller 339 of the pressure unit 14. The lifting mechanism 26 causes the pressure roller 339 to move upward to separate from the coating roller 338 when the treatment liquid is not applied, and the contact state (NIP state) between the coating roller 338 and the pressure roller 339 can be released.

Part of the reciprocating mechanism 11, the pressure unit 14, and the coating unit 15 are surrounded by a housing 10.

The pressure unit 14 including the pressure roller 339 is fixed to the housing 10. That is, the pressure roller 339 is rotatably fixed to the housing 10.

The coating unit 15, serving as the treatment liquid retainer, retains the treatment liquid and fixes the coating roller 338 and the squeeze roller 337 rotatably inside. Further, the coating unit 15 is provided in the housing 10 to be movable in a width direction of the recording medium W (orthogonal to the direction in which the recording medium W is conveyed).

Specifically, positioning of the coating unit 15 is performed relative to the position of the conveyance direction of the recording medium W by inserting multiple guide pins 16 fixed to the coating unit 15 into holes in a positioning plate 17 fixed to the housing 10.

By engaging a latch pin 12 fixed to the coating unit 15 with a latch 27 of the reciprocating mechanism 11, positioning of the coating unit 15 is performed in the width direction of the recording medium W. The reciprocating mechanism 11, coupled to the coating unit 15 via the latch pin 12, reciprocates the coating unit 15 continuously or intermittently in the width direction of the recording medium W.

The reciprocating mechanism 11, illustrated as surrounded by an area indicated by alternate long and short dashed lines in FIG. 3, includes the latch 27, a slider 30 as a moving body, a screw shaft 29, and a position detection marker 28, inside the housing 10 and includes a motor (reciprocation motor) 31 disposed outside of the housing 10.

By driving the motor 31, coupled to a screw shaft 29, fixed to the housing 10, the screw shaft 29 is rotated to slide the slider 30 along the screw shaft 29 in the horizontal direction (i.e., width direction of the recording medium W). By reciprocating the slider 30 in this direction, the coating unit 15, coupled to the slider 30 via the latch pin 12 and the latch 27, is reciprocated.

That is, by moving the slider (moving body) 30 coupled to the coating unit 15 (treatment liquid retainer), the coating unit 15 is moved inside the housing 10, which reciprocates the coating roller 338 that is held in the coating unit 15 relative to the pressure roller 339 in the width direction of the recording medium W.

Multiple position sensors 13 such as a photo interrupter, provided adjacent to the reciprocating mechanism 11, detect the position of the reciprocating mechanism 11.

Specifically, a reciprocation width of the coating unit 15, that is, a width in which the coating unit 15 is moved relative to the width direction of the recording medium W, is determined, and therefore, the moving width of the reciprocating mechanism 11 is determined. When the position sensor 13 detects that the reciprocating mechanism 11 reaches either end of the moving width, the position sensor 13 outputs the end detection result of the reciprocating mechanism 11, and the reciprocation controller 82 reverses a travel direction in reciprocation of the reciprocating mechanism 11.

Further, the position sensor 13 detects the position relative to a position detection target 28 in the reciprocating mechanism 11 at the timing at which the printing is terminated, and outputs the detected position to an IC chip (storage device). The detected position is read and used when the next time printing is started.

Herein, as the position sensor 13, multiple sensor elements are arranged in a line along the movement direction of the reciprocating mechanism 11, and the sensor elements of sensor 13 located at both edges of the line detect that the reciprocating mechanism 11 reaches at respective ends of a movement width.

Alternatively, when the printing is finished, the position of the reciprocating mechanism 11 is detected by, which element of sensor elements is nearest to the position detection target 28, or which interval between the sensor elements is the position detection target 28 located at.

Furthermore as illustrated in FIG. 3, the position detection target 28 may be provided for use in detecting the position of the slider 30 by the reciprocating mechanism 11. FIG. 3 gives an example in which a single position detection target 28 is provided, but the number is not limited;
alternatively multiple position detection targets may be provided.

The reciprocation controller 82, connected to the reciprocating mechanism 11, is connected to the coating controller 81 and a controller of the image forming system 1000. The reciprocation controller 82 controls the travel direction in the reciprocation, a reciprocating speed, and the driving period of the slider 30 of the reciprocating mechanism 11, in accordance with the coating amount determined based on the sheet type and resolution, the printing speed, and the detected data of the position of the reciprocating mechanism 11.

Herein, the IC chip is provided in the coating unit 15, and the stop position and the travel direction at termination of last printing time is stored. At the next printing time, the data of the moving position and the travel direction is read and the reciprocation is started at the stored moving position and the travel direction. Due to this operation, the abrasion amount on the surface of the coating roller 338 can be made uniform within the reciprocation width.

The recording medium W is coated with the treatment liquid L with reciprocation, and is then conveyed to the heating device 350.

EMBODIMENT

Figure 4:
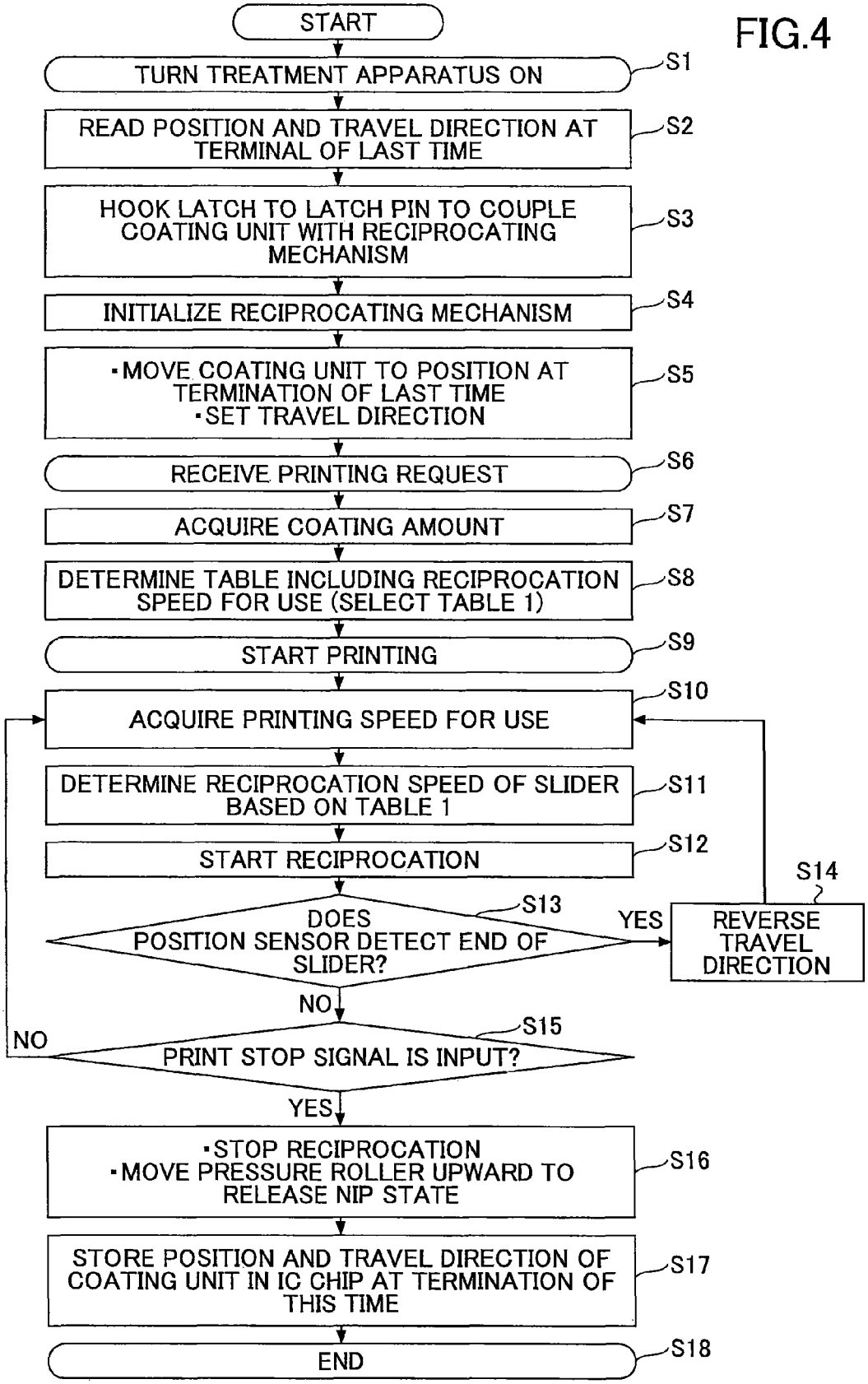
FIG. 4 is a flowchart illustrating a reciprocation mechanism shown in FIG. 3, according to a first embodiment.
Figure 5:
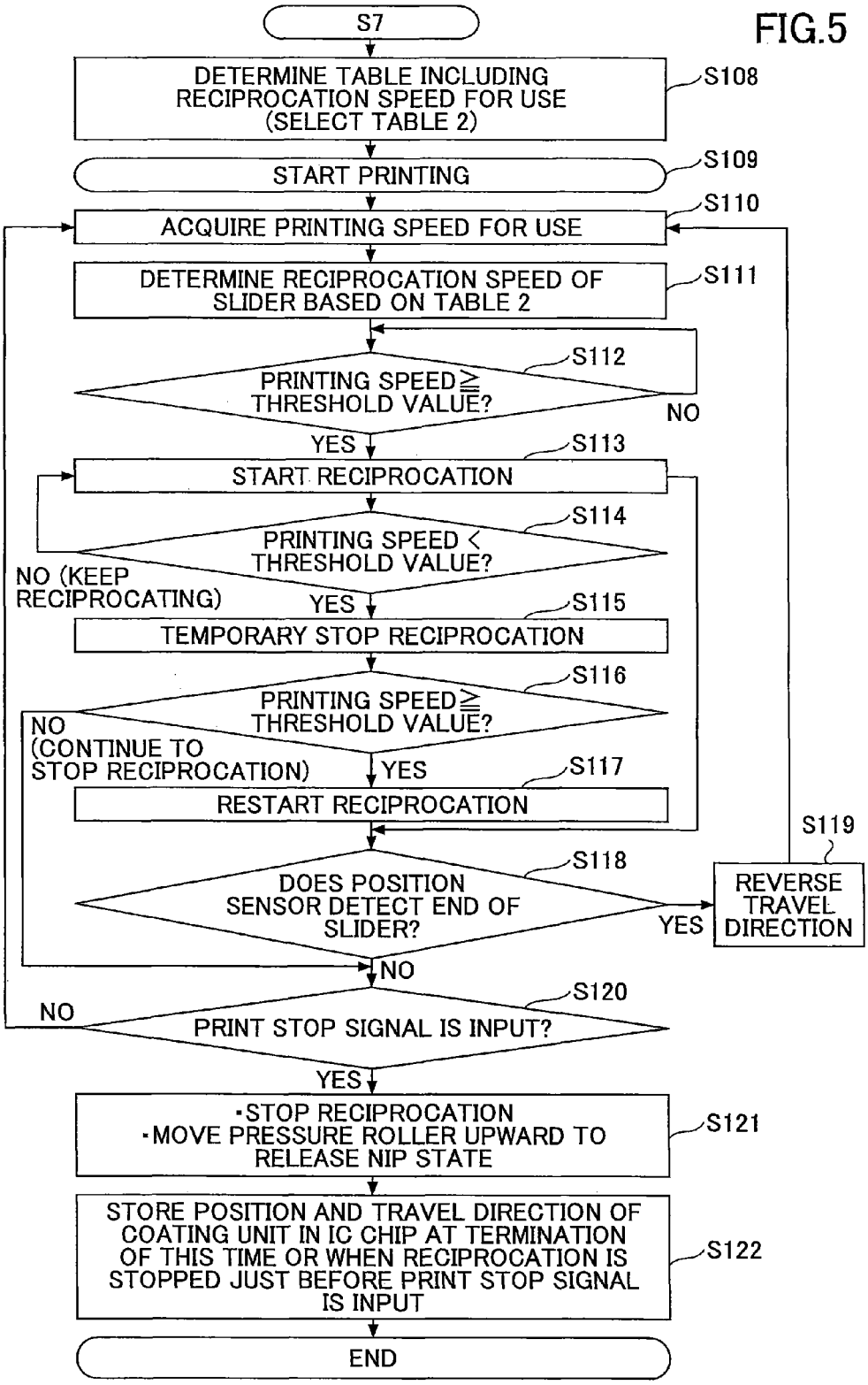
FIG. 5 is a flowchart illustrating a reciprocation mechanism shown in FIG. 3, according to a second embodiment.
Figure 6:
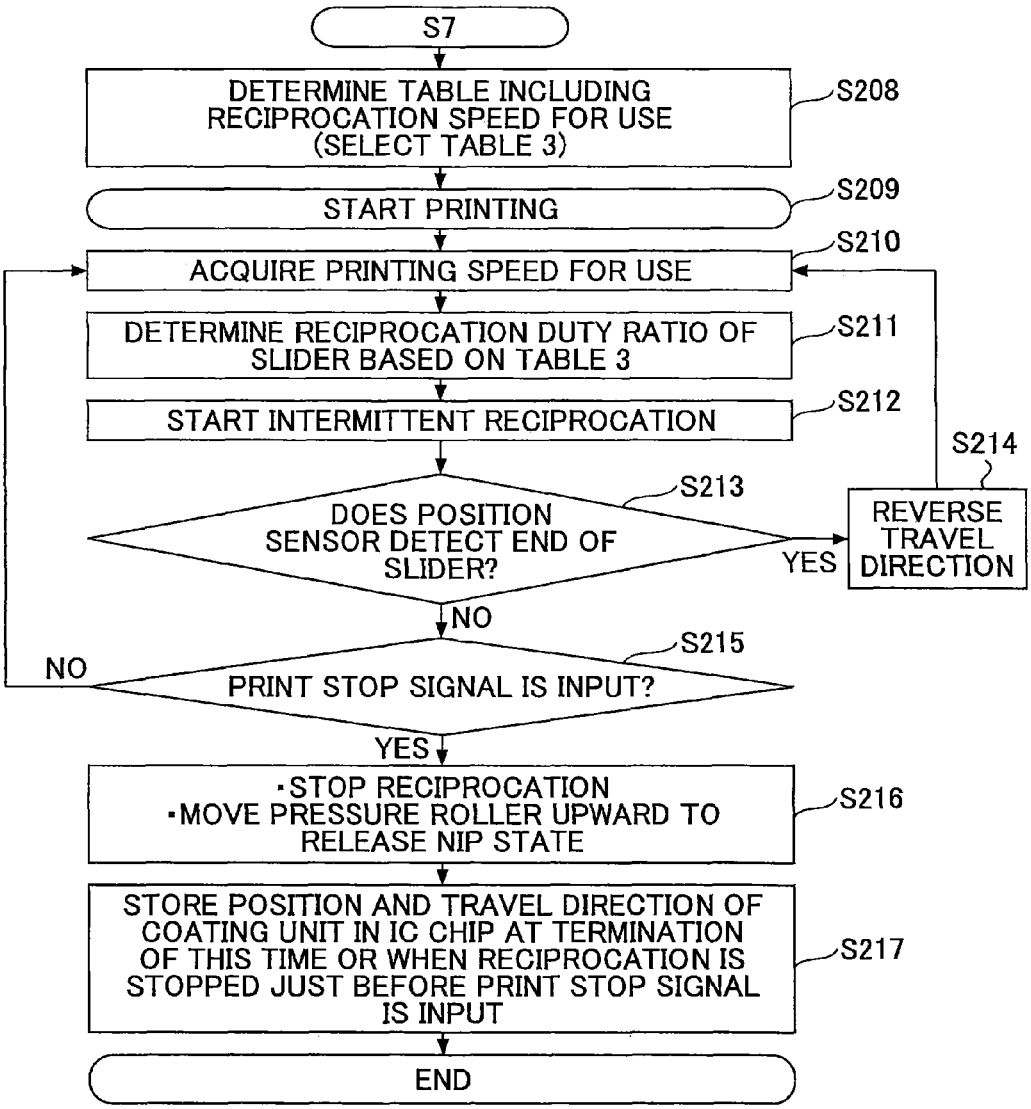
FIG. 6 is a flowchart illustrating a reciprocation mechanism shown in FIG. 3, according to a third embodiment.

FIGS. 4 through 6 illustrate flowcharts of controlling operation. FIG. 4 is a flowchart to illustrate operational flow of the embodiment 1 when the reciprocating mechanism 11 is continuously horizontally reciprocated.

First Embodiment

Initially, at step S1, the pretreatment liquid coating device 330 is turned on. At step S2, the IC chip in the coating unit 15 reads out the data of the position of the coating unit 15 and the travel direction at termination of last printing process. Thus, the reciprocation controller 82 can set the position and the travel direction of the coating unit 15 to the same position and same travel direction as those in the last coating process. Therefore, even when the printing operation is executed many times, a contact portion of the surface of the coating roller that comes in contact with the edges of the recording medium W can be dispersed.

It is to be noted that the coating unit 15 is sometimes exchanged due to maintenance operations. At the time of starting printing, the coating controller 81 confirms whether or not the coating unit 15 is properly installed, using the installation that the IC chip is located in the coating unit 15, depending on whether the IC chip is properly read.

Next, at step S3, the latch 27 of the reciprocating mechanism 11 is moved and is hooked to the latch pin 12 of the coating unit 15 so as to couple the coating unit 15 with the reciprocating mechanism 11.

After the coupling, the reciprocating mechanism 11 in the pretreatment apparatus 101 is initialized, and the elements of the reciprocating mechanism 11, such as sensors and motors, are confirmed at step S4. After initialization, the motor 31 of the reciprocating mechanism 11 rotates the screw shaft 29 so as to move both the coating unit 15 and the reciprocating mechanism 11 so that the position of the coating unit 15 is set to be the same as the stored position at termination of last printing process. At this time, the travel direction, that is an advancing direction, is set to be the same as the stored travel direction at termination of last printing process (S5).

When a printing request from the controller is received (S6), the coating controller 81 determines the coating amount based on the type of the recording medium and the resolution acquired from the controller, and then adjusts the nip pressure between the pressure roller 339 and the coating roller 338.

The coating amount of the treatment liquid is made different to satisfy the image quality in accordance with the paper type and the resolution. More specifically, the coating controller 81 calculates the coating amount of the pretreatment liquid based on the resolution of the image (the number of dots per area). Herein, when the image having low resolution is formed, the ink dot radius to be formed on the recording medium is greater than that for the high resolution. The respective dots for the low resolution are less likely to dry because the area rate of the ink is great relative to the surface area. In addition, since the printing speed for the low resolution is faster than that for the high resolution, the ink is less likely to dry and to permeate into the recording medium, which is more likely to generate the image blur and beading. Accordingly, the coating amount of the pretreatment liquid L is decreased when the formed image is to have high resolution and the coating amount is increased when the formed image is to have low resolution.

Furthermore, the coating controller 81 calculates the coating amount of the pretreatment liquid L in the coating unit 15 based on the type of the recording medium W. Specifically, the coating controller 81 calculates the coating amount based on the corresponding type of the recording medium W. The coating controller 81 reads the corresponding type of the recording medium W based on the input information in the image forming system 1000 input by the user, and outputs the coating amount corresponding to the type of the recording medium W to the reciprocation controller 82 (S7).

Then, at step S8, the reciprocation controller 82 determines a speed table used for control, based on the acquired coating amount. In the present embodiment, following Table 1 is selected.

During reciprocation, when the position sensor 13 detects that the slider 30 of the reciprocating mechanism 11 reaches either end of the movement width as end detection (Yes at S13), the reciprocation controller 82 reverses the travel direction of the slider 30 of the reciprocating mechanism 11 at step S14.

After the travel direction is reversed at S14, that is, after the position sensor 13 detects that the slider 30 reaches either end of the movement width and the travel direction of the slider 30 is reversed, the process returns to step S10 and the printing speed is acquired again from the controller to restart the reciprocation.

During reciprocation, when the position sensor 13 does not detect that the slider 30 of the reciprocating mechanism 11 reaches either end of movement width (NO at S13), the reciprocating mechanism 11 is kept moving in the same direction (one direction).

TABLE 1

| RECIPROCATING SPEED | | SHEET TYPE: SHEET TYPE A (COATING PAPER) IMAGE RESOLUTION 600 × 600 dpi | SHEET TYPE: SHEET TYPE A (COATING PAPER) IMAGE RESOLUTION 1200 × 1200 dpi | SHEET TYPE: SHEET TYPE B (PLAIN PAPER) IMAGE RESOLUTION 600 × 600 dpi | SHEET TYPE: SHEET TYPE B (PLAIN PAPER) IMAGE RESOLUTION 1200 × 1200 dpi |
|---|---|---|---|---|---|
| PRINTING SPEED | 0 m/min | 0.0 mm/s | 0.0 mm/s | 0.0 mm/s | 0.0 mm/s |
| | 10 m/min | 2.5 mm/s | 2.0 mm/s | 1.5 mm/s | 1.0 mm/s |
| | 20 m/min | 5.0 mm/s | 4.0 mm/s | 3.0 mm/s | 2.0 mm/s |
| | 30 m/min | 7.5 mm/s | 6.0 mm/s | 4.5 mm/s | 3.0 mm/s |
| | 40 m/min | 10.0 mm/s | 8.0 mm/s | 6.0 mm/s | 4.0 mm/s |
| | 50 m/min | 12.5 mm/s | 10.0 mm/s | 7.5 mm/s | 5.0 mm/s |
| | 60 m/min | 15.0 mm/s | 12.0 mm/s | 9.0 mm/s | 6.0 mm/s |
| | 70 m/min | 17.5 mm/s | 14.0 mm/s | 10.5 mm/s | 7.0 mm/s |
| | 80 m/min | 20.0 mm/s | 16.0 mm/s | 12.0 mm/s | 8.0 mm/s |
| | 90 m/min | 22.5 mm/s | 18.0 mm/s | 13.5 mm/s | 9.0 mm/s |
| | 100 m/min | 25.0 mm/s | 20.0 mm/s | 15.0 mm/s | 10.0 mm/s |

As previously set at S7, because the coating amount of the pretreatment liquid required for satisfying the image quality per the paper type and the resolution differs, the reciprocation controller 82 selects the appropriate speed table so that coating roller 338 is reciprocated in accordance with the required coating amount of the treatment liquid.

Specifically, the reciprocation controller 82 selects Table 1 (speed table) so as to adjust the reciprocating speed of the reciprocating mechanism 11 and adjust the total reciprocation amount so that the reciprocation is set faster in the case in which the coating amount is great and the recording medium W is more likely to slip on the coating roller 338, and reciprocation is set slower in the case in which the coating amount is small and the recording medium W is less likely to slip on the coating roller 338.

For example, using Table 1 through table 3, the reciprocating speed is changed corresponding to the printing speed. In the flowchart shown in FIG. 4, for example, Table 1 is selected for the case in which the coating amount is great. Herein, the reciprocation speed numbers in Table 1 are in mm/s.

When printing is started at S9, the controller of the image forming system 1000 acquires the printing speed for the first inkjet printer 102 (S10).

The reciprocation controller 82 collates the printing speed acquired from the controller and Table 1, and determines a reciprocating speed at S11. The reciprocation controller 82 starts driving the reciprocating mechanism 11 to start reciprocating the coating unit 15 at S12.

Then, unless the print stop signal is input (No at S15), the reciprocation is kept while the information on the printing speed is acquired as needed (return to S10).

During reciprocation, when the input of the print stop signal is confirmed (Yes at S15), the reciprocation is stopped, and the lifting mechanism 26 moves the pressure roller 339 upward and the pressure contact (nip state) between the pressure roller 339 and the coating roller 338 is released at step S16. Herein, when the reciprocation is stopped, the position sensor 13 detects the position of the slider 30 of the reciprocating mechanism 11 to detect the position of the coating unit 15.

At step S17, the IC chip stores the detected position of the slider 30 (and/or the coating unit 15) at termination of this printing process, and stores the travel direction of the slider 30 controlled by the reciprocation controller 82 at termination of this printing process.

Then, the printing process is terminated.

Herein, in order to prevent abrasion of the coating roller 338, it is preferable that the position of the coating roller 338 be moved (reciprocally moved) relative to the conveyance position of the recording medium W at a speed as high as possible. However, as the reciprocating speed is increased relative to the printing speed (sheet conveyance speed), the coating roller 338 is adversely affected by the reciprocation. In the condition in which the reciprocation is performed at a constant speed and at the same of the coating amount, when the printing speed is fast relative to the reciprocating speed, meandering conveyance and wrinkling the recording medium become moderate.

By contrast, when the printing speed is slow relative to the reciprocating speed, meandering conveyance and wrinkling the recording medium occur greatly. In order to solve these problems, the reciprocating speed changes in accordance with the printing speed.

With reference to the flow shown in FIG. 4, the reciprocation controller 82 controls the reciprocating mechanism 11 to adjust the reciprocating speed of the slider 30 so that, in the case in which the coating amount is great and the recording medium W is more likely to slip, the reciprocating speed is set faster, and in the case in which the coating amount is small and the recording medium W is less likely to slip, the reciprocating speed is set slower. Further, the reciprocating mechanism 11 adjusts the reciprocating speed of the coating roller 338 based on the printing speed. Due to this adjustment, the abrasion at the contact portion of the coating roller 338 is dispersed; which prevents meandering conveyance and wrinkling the recording medium affected from the reciprocation of the coating roller 338.

In addition, at the processes executed at steps S2 and S17, the stop position and the travel direction of the coating unit 15 at termination of the last printing process is stored and then the reciprocation is started at the position in the stored travel direction. Accordingly, the abrasion of the coating roller 338 can be made uniform in the movement width of the coating roller 338.

The flowchart shown in FIG. 4 shows the embodiment 1 in which the reciprocating mechanism is continuously reciprocated, but alternatively, the reciprocation can be driven intermittently.

Second Embodiment

FIG. 5 is a flowchart illustrating the operation in the reciprocating mechanism 11 in a case in which the coating roller 338 is intermittently moved, according to a second embodiment. Intermittent reciprocation means that the coating roller 338 is reciprocated and stopped regularly or randomly.

Since the operations at steps S1 through S7 until the appropriate table is selected are common, the description is omitted. In this control, the difference of the second embodiment from the first embodiment is that the reciprocating mechanism 11 stops reciprocating the slider 30 and the coating unit 15 in a period during which the printing speed is lower than a predetermined threshold value.

First, the nip pressure is adjusted by acquiring the data of the coating amount at step S7 in FIG. 4. At step S108 in FIG. 5, a speed table shown as a following Table 2 is selected based on the data of the coating amount of the pretreatment liquid.

TABLE 2

| RECIPROCATING SPEED | | SHEET TYPE: SHEET TYPE A (COATING PAPER) IMAGE RESOLUTION 600 × 600 dpi | SHEET TYPE: SHEET TYPE A (COATING PAPER) IMAGE RESOLUTION 1200 × 1200 dpi | SHEET TYPE: SHEET TYPE B (PLAIN PAPER) IMAGE RESOLUTION 600 × 600 dpi | SHEET TYPE: SHEET TYPE B (PLAIN PAPER) IMAGE RESOLUTION 1200 × 1200 dpi |
|---|---|---|---|---|---|
| PRINTING SPEED | 0 m/min | 0.0 mm/s | 0.0 mm/s | 0.0 mm/s | 0.0 mm/s |
| | 10 m/min | 0.0 mm/s | 0.0 mm/s | 0.0 mm/s | 0.0 mm/s |
| | 20 m/min | 0.0 mm/s | 0.0 mm/s | 0.0 mm/s | 0.0 mm/s |
| | 30 m/min (THRESHOLD VALUE) | 2.5 mm/s | 2.0 mm/s | 1.5 mm/s | 1.0 mm/s |
| | 40 m/min | 5.0 mm/s | 4.0 mm/s | 3.0 mm/s | 2.0 mm/s |
| | 50 m/min | 7.5 mm/s | 6.0 mm/s | 4.5 mm/s | 3.0 mm/s |
| | 60 m/min | 10.0 mm/s | 8.0 mm/s | 6.0 mm/s | 4.0 mm/s |
| | 70 m/min | 12.5 mm/s | 10.0 mm/s | 7.5 mm/s | 5.0 mm/s |
| | 80 m/min | 15.0 mm/s | 12.0 mm/s | 9.0 mm/s | 6.0 mm/s |
| | 90 m/min | 17.5 mm/s | 14.0 mm/s | 10.5 mm/s | 7.0 mm/s |
| | 100 m/min | 20.0 mm/s | 16.0 mm/s | 12.0 mm/s | 8.0 mm/s |

Table 2 (speed table) is applied for the case in which the coating amount is less than that in Table 1.

More specifically, even after printing is started, in Table 2, when the printing speed is slower than the threshold value (e.g., 30 m/min shown in Table 2), the slider 30 and the coating unit 15 of the reciprocating mechanism 11 are not moved. Then, when the printing speed (defined in Table 2) becomes faster than the threshold value (YES at S112), the reciprocation is started based on Table 2 (S113). Herein, during printing operations (No at S114), in the case in which the printing speed never becomes slower than the threshold value, the process proceeds to step S118 while adjusting the reciprocating speed appropriately without stopping reciprocating.

Herein, even when the coating unit 15 moves, in the case in which the printing speed becomes slower than the predetermined threshold value (Yes at S114), the reciprocation is temporarily stopped based on Table 2 (S115).

Then, when the printing speed become faster than the threshold value (Yes at S116), the reciprocation is restarted based on Table 2. Otherwise, when the printing speed does not become faster than the threshold value (No at S116), the coating unit 15 is continued to stop reciprocation.

Thus, while the reciprocation is repeated operating and stopping, the driving period during which the reciprocation controller 82 moves the coating unit 15 is adjusted based on Table 2 selected based on the coating amount of the pretreatment liquid (steps S112 through S117). In other words, the reciprocation controller 82 adjusts the stop period during which the reciprocation of the slider 30 is stopped and the reciprocation of the coating unit 15 is adjusted based on Table 2 corresponding to the printing speed.

In this flow, compared to the flow 1 shown in FIG. 4, the condition in which the coating amount is small and slipping is less likely to occur enables reducing power consumption in the motor 31 that drives the reciprocation.

In this control, while the reciprocation is temporarily stopped, the position sensor 13 detects the position of the slider 30 to detect the position of the coating unit 15. Then, at step S122, the IC chip stores the position and the travel direction of the slider 30 and/or the coating unit 15 when the reciprocation is being executed at the timing at which printing is terminated. Alternatively, in a case in which the reciprocation is not being executed at the timing at which the printing is terminated (No at step 116), the IC chip stores the position and the travel direction of the slider 30 and/or the coating unit 15 when the reciprocation is stopped just before the print stop signal is input.

Further, in the case in which the coating amount is great and the recording medium W is more likely to slip on the coating roller 338, the reciprocation is set at the fast speed, which can disperse the abrasion at the contact portion of the coating roller 338 and prevents meandering conveyance and wrinkling the recording medium W.

Third Embodiment

FIG. 6 is a flowchart illustrating the operation of the coating mechanism 33 in the case in which the slider 30 of the reciprocating mechanism 11 is intermittently driven at a predetermined constant cycle, according to a third embodiment. The process at steps S1 through S7 until the appropriate table is selected is common to FIG. 5, and therefore, the description thereof is omitted. In this embodiment, as the intermittent reciprocation, the reciprocation is regular and the reciprocation and stop reciprocation are repeated at a constant cycle having a predetermine duty ratio.

In this control, the reciprocating mechanism 11 repeats reciprocation and stop reciprocation of the coating roller 338, and the reciprocating mechanism 11 adjusts the reciprocation period in the predetermine cycle based on the printing speed.

After the nip pressure is adjusted using the acquired data of the coating amount at step S5 in FIG. 4, at step S208 in FIG. 6, Table 3 representing reciprocation interval (duty ratio) is selected, instead of the speed table shown in Table 1 or 2.

The reciprocation controller 82 determines the duty ratio based on Table 3 (S209, S210, S211), which causes the slider 30 to intermittently move (reciprocate) the coating unit 15 (S212).

Herein, in this control, when the reciprocation is temporarily stopped in the intermittent reciprocation, the position sensor 13 detects the position of the slider 30 of the reciprocating mechanism 11 to detect the position of the coating unit 15. Then, at the process at step S217, the IC chip stores the position and the travel direction of the slider 30 and/or the coating unit 15 when the reciprocation is executed at the timing at which printing is terminated. Alternatively, in a case in which the reciprocation is not executed at the timing at which the printing is terminated (No at step 215), the IC chip stores the position and the travel direction of the slider 30 and/or the coating unit 15 when the reciprocation is stopped just before the print stop signal is input.

It is to be noted that, since the operation of the reciprocation is controlled by adjusting intervals of the intermittent reciprocation in this embodiment, the reciprocation speed may be set to be constant. Adjusting the interval of the intermittent reciprocation shown in Table 3 can achieve the same effects as described in the first and the second embodiment.

As described above, the reciprocating mechanism 11 adjusts the driving period of the reciprocation of the coating roller 338 (i.e., the stop period of stop reciprocation), based on the printing speed. Therefore, the abrasion at the contact portion of the coating roller 338 can be alleviated and meandering conveyance and wrinkling the recording medium W can be prevented.

[Description of Abrasion of Coating Roller]

Figure 7A:
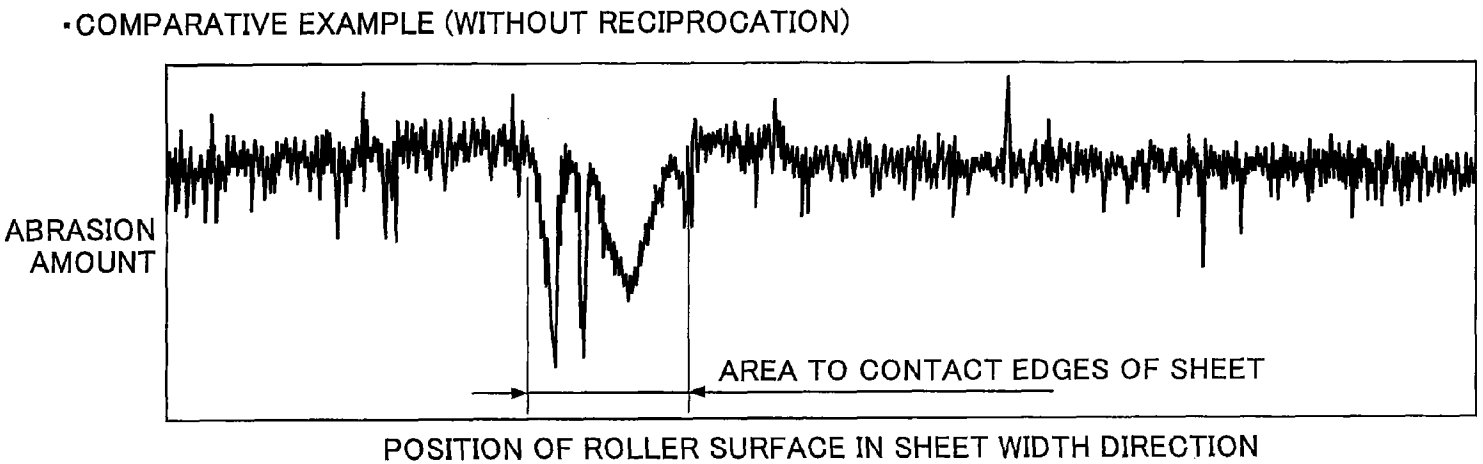
FIGS. 7A and 7B are diagrams illustrating abrasion in a coating roller with and without the reciprocation of the coating unit.
Figure 7B:
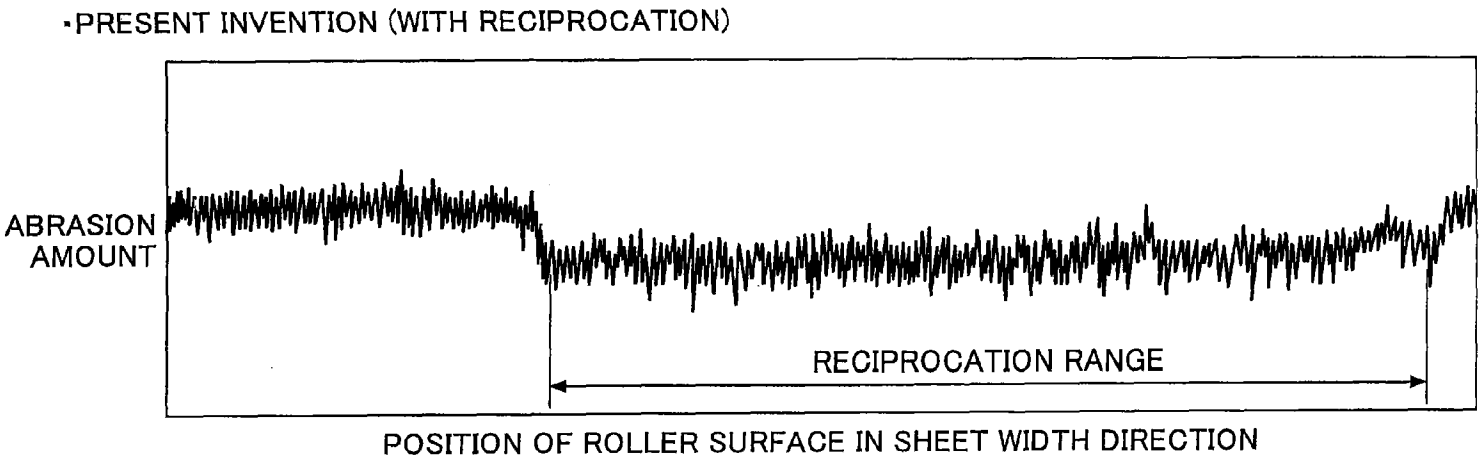
Figure 8:
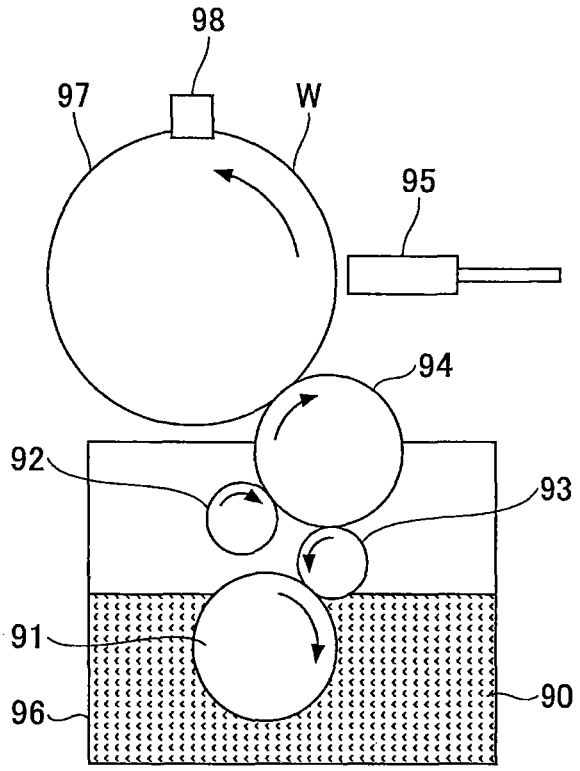
FIG.8 RELATED ART
FIG. 8 is a schematic cross sectional diagram illustrating a configuration in which coating material is applied to sheets using rollers, according to the related art.

FIGS. 7A and 7B are graphs illustrating the degree of the abrasion of the coating roller 338, with and without reciprocation of the coating unit 15. In FIGS. 7A and 7B, a horizontal axis shows the position in the coating roller in the width direction of the recording medium (sheet width direction), and a vertical axis shows the degree of abrasion (Abrasion amount).

TABLE 3

| RECIPROCATING DUTY RATIO | | SHEET TYPE: SHEET TYPE A (COATING PAPER) IMAGE RESOLUTION 600 × 600 dpi | SHEET TYPE A (COATING PAPER) 1200 × 1200 dpi | SHEET TYPE B (PLAIN PAPER) 600 × 600 dpi | SHEET TYPE B (PLAIN PAPER) 1200 × 1200 dpi |
|---|---|---|---|---|---|
| PRINTING SPEED | 0 m/min | 0% | 0% | 0% | 0% |
| | 10 m/min | 10% | 8% | 6% | 4% |
| | 20 m/min | 20% | 16% | 12% | 8% |
| | 30 m/min | 30% | 24% | 18% | 12% |
| | 40 m/min | 40% | 32% | 24% | 16% |
| | 50 m/min | 50% | 40% | 30% | 20% |
| | 60 m/min | 60% | 48% | 36% | 24% |
| | 70 m/min | 70% | 56% | 42% | 28% |
| | 80 m/min | 80% | 64% | 48% | 32% |
| | 90 m/min | 90% | 72% | 54% | 36% |
| | 100 m/min | 100% | 80% | 60% | 40% |

In Table 3 representing the duty ratio cycle, the predetermined reciprocation cycle is defined, corresponding to the printing speed. For example, in the condition in which paper type A of the recording medium having image resolution of 600×600 dpi and printing speed of 10 mpm, a 10% duty ratio indicates that, in the cycle where the slider 30 goes and returns in the movement width of 100 sec, ON period during which the motor 31 drives the reciprocation of the slider 30 is 10 sec.

With reference to FIG. 7A of the graph without the reciprocation; in the comparative example in which the coating roller is not moved, the roller surface is deeply abraded at a narrower contact portion thereof that comes in contact with the edges of the recording medium W. For example, when a roll of continuous sheet is used as the recording medium W, the amount of using recording medium for 1 printing job sometimes exceeds 16 km. Therefore, even though the contact portion of the roller surface that comes in contact with the recording medium is moved after the print is finished, the abrasion exceeds the allowance value.

By contrast, with reference to FIG. 7B of the graph with reciprocation, in the condition in which the reciprocation is executed according to the embodiments of the present invention, it can be understood that the surface of the coating roller 338 is abraded uniformly within the reciprocation width. Namely, by moving the coating unit 15 during printing operations, the abrasion at the contact portion where the roller comes in contact with the edges of the recording medium W in the contact nip between the coating roller 338 and the pressure roller 339 can be alleviated.

Furthermore, since the abrasion occurs widely and shallowly, the case in which the pretreatment liquid is not applied to a specific portion of the surface of the recording medium can be prevented. In the above-described embodiments, the reciprocating mechanism is applied to the coating device that applies the pretreatment liquid before the ink is applied, but the coating device having the reciprocation mechanism can be applied to a coating of an after-treatment liquid.

As described in the foregoing, it is possible for the treatment liquid coating apparatus according to the present invention, to alleviate the abrasion in an area of the roller surface that comes in contact with the edges of the sheet, with a simple structure.

The treatment liquid coating apparatus and the image forming system according to the present invention are not limited to the above-described embodiments, and variations and modifications may be made without departing from the scope of the present invention.

The present application is based upon and claims the benefit of priority of Japanese Patent Application No. 2014-012728, filed on Jan. 27, 2014, the content of which is incorporated herein by reference.

What is claimed is:

1. A treatment liquid coating apparatus comprising:

a conveyance member configured to convey a recording medium, a coating roller configured to apply treatment liquid on the recording medium, driven to rotate with conveyance of the recording medium by the conveyance member;

a pressure roller configured to press against the coating roller to hold the recording medium that is placed between the coating roller and the pressure roller; and a reciprocating mechanism to reciprocate the coating roller in a direction perpendicular to the conveyance of the recording medium during printing.

2. The treatment liquid coating apparatus as claimed in claim 1, wherein a reciprocating speed of the coating roller is adjusted based on a printing speed.

3. The treatment liquid coating apparatus as claimed in claim 1, wherein a reciprocating speed of the coating roller is adjusted based on the coating amount of the treatment liquid.

4. The treatment liquid coating apparatus as claimed in claim 1, wherein the reciprocating mechanism determines whether the coating roller is intermittently reciprocated, based on a printing speed.

5. The treatment liquid coating apparatus as claimed in claim 4, wherein, in a state where the coating roller is intermittently reciprocated, a period of time during which reciprocating the coating roller is temporarily stopped is adjusted, based on the printing speed.

6. The treatment liquid coating apparatus as claimed in claim 4, wherein, in a state where the coating roller is intermittently reciprocated, the reciprocation of the coating roller is stopped for a period during which the printing speed is slower than a predetermined threshold value.

7. The treatment liquid coating apparatus as claimed in claim 4, wherein, in a state where the coating roller is intermittently reciprocated, the coating roller is cyclically repeatedly reciprocated and stopped, and the reciprocating mechanism adjusts a reciprocating period in each predetermined cycle, based on a printing speed.

8. The treatment liquid coating apparatus as claimed in claim 1, wherein the reciprocating mechanism determines whether the coating roller is intermittently reciprocated, based on the coating amount of the treatment liquid.

9. The treatment liquid coating apparatus as claimed in claim 8, wherein, in a state where the coating roller is intermittently reciprocated, the period of time during which reciprocation of the coating roller is temporarily stopped is controlled, based on the coating amount of the treatment liquid.

10. The treatment liquid coating apparatus as claimed in claim 1, further comprising:

a storage device configured to store a position and a travel direction of the coating roller at termination of a last printing process, and to cause the reciprocating mechanism to operate so that the coating roller restarts reciprocation at the position and in the travel direction stored in the storage device.

11. The treatment liquid coating apparatus as claimed in claim 1, wherein the reciprocating mechanism comprises a fixed motor, a screw shaft connected to the fixed motor, and a moving body movable along the screw shaft, and wherein the fixed motor rotates the screw shaft to reciprocally move the moving body in the direction perpendicular to the conveyance of the recording medium, to reciprocate the coating roller.

12. The treatment liquid coating apparatus as claimed in claim 1, further comprising:

a housing configured to surround the coating roller, the pressure roller, and a part of the reciprocating device, and a treatment liquid retainer configured to retain the treatment liquid and hold the coating roller movably, provided in the housing movable in the width direction of the recording medium, wherein the pressure roller is rotatably fixed to the housing, the reciprocating mechanism is movable relative the housing to which a motor is fixed, reciprocation of the reciprocating mechanism connected to the treatment liquid retainer causes the treatment liquid retainer to move in the direction perpendicular to the conveyance of the recording medium, to cause the coating roller provided in the treatment liquid retainer to reciprocate relative to the pressure roller in the direction perpendicular to the conveyance of the recording medium.

13. An image forming system, comprising:

a conveyance member configured to convey a recording medium, an image forming device configured to eject ink onto the recording medium onto which the ink is to be adhered, and a pretreatment device, provided upstream from the image forming device in a direction in which the recording medium is conveyed, the pretreatment device including a coating roller configured to apply treatment liquid on the recording medium, driven to rotate with conveyance of the recording medium by the conveyance member;

a pressure roller configured to press against the coating roller to hold the recording medium that is placed between the coating roller and the pressure roller; and a reciprocating mechanism to reciprocate the coating roller in a direction perpendicular to the conveyance of the recording medium during printing.

* * * * *